US011008786B2

(12) United States Patent
Im et al.

(10) Patent No.: US 11,008,786 B2
(45) Date of Patent: May 18, 2021

(54) TRUNK LID LATCH ASSEMBLY FOR VEHICLE

(71) Applicants: Hyundai Motor Company, Seoul (KR); Kia Motors Corporation, Seoul (KR); PYEONG HWA AUTOMOTIVE CO., LTD., Daegu (KR)

(72) Inventors: Yong Hyuck Im, Seoul (KR); Mun Bae Tak, Daegu (KR)

(73) Assignees: Hyundai Motor Company, Seoul (KR); Kia Motors Corporation, Seoul (KR); Pyeong Hwa Automotive Co, Ltd., Daegu (KR)

( * ) Notice: Subject to any disclaimer, the term of this patent is extended or adjusted under 35 U.S.C. 154(b) by 677 days.

(21) Appl. No.: 15/820,939

(22) Filed: Nov. 22, 2017

(65) Prior Publication Data

US 2018/0347239 A1 Dec. 6, 2018

(30) Foreign Application Priority Data

Jun. 2, 2017 (KR) ..... 10-2017-0069169

(51) Int. Cl.

| | |
|---|---|
| ***E05B 83/18*** | (2014.01) |
| ***E05B 81/20*** | (2014.01) |
| ***E05B 81/16*** | (2014.01) |
| *E05B 81/34* | (2014.01) |
| *E05B 81/06* | (2014.01) |
| *E05B 81/90* | (2014.01) |
| *E05B 81/66* | (2014.01) |

(52) U.S. Cl.

CPC ..... *E05B 81/20* (2013.01); *E05B 81/16* (2013.01); *E05B 81/06* (2013.01); *E05B 81/66* (2013.01); *E05B 81/90* (2013.01); *Y10T 292/1047* (2015.04); *Y10T 292/1082* (2015.04); *Y10T 292/308* (2015.04)

(58) Field of Classification Search

CPC ..... Y10T 292/1047; Y10T 292/1082; Y10T 292/307; Y10T 292/308; E05B 81/06; E05B 81/16; E05B 81/20; E05B 81/66; E05B 81/90; Y10S 292/42

See application file for complete search history.

(56) References Cited

U.S. PATENT DOCUMENTS

| | | | | |
|---|---|---|---|---|
| 4,395,064 A * | 7/1983 | Bellot | ..... | E05B 81/20 292/201 |
| 6,422,615 B1 * | 7/2002 | Roos | ..... | E05B 81/20 292/201 |
| 6,499,776 B2 * | 12/2002 | Takamura | ..... | E05B 81/20 292/201 |
| 6,637,783 B2 * | 10/2003 | Takamura | ..... | E05B 81/14 292/201 |

(Continued)

FOREIGN PATENT DOCUMENTS

| | | | | |
|---|---|---|---|---|
| JP | 2008-013932 A | 1/2008 | | |
| WO | WO-2018030556 A2 * | 2/2018 | ..... | E05B 81/22 |

*Primary Examiner* — Carlos Lugo

(74) *Attorney, Agent, or Firm* — Morgan, Lewis & Bockius LLP

(57) ABSTRACT

A trunk lid latch assembly for a vehicle may include a main gear rotated by a drive motor provided at the base, wherein an error lever, a pawl lever, a plurality of links, and a cinching member are rotated in conjunction with rotation of the main gear, and thus a striker is locked or unlocked from the claw.

14 Claims, 10 Drawing Sheets

(56) References Cited

U.S. PATENT DOCUMENTS

| | | | | |
|---|---|---|---|---|
| 6,685,239 | B2 * | 2/2004 | Yamauchi | E05B 81/20 292/144 |
| 6,698,804 | B2 * | 3/2004 | Shiota | E05B 81/20 292/201 |
| 7,434,853 | B2 * | 10/2008 | Yamamoto | E05B 81/14 292/201 |
| 7,762,594 | B2 * | 7/2010 | Arabia, Jr. | E05B 81/20 292/201 |
| 8,783,738 | B2 * | 7/2014 | Watanabe | E05B 85/26 292/201 |
| 8,864,187 | B2 * | 10/2014 | Jitsuishi | E05F 15/40 292/201 |
| 10,697,209 | B2 * | 6/2020 | Kim | E05B 81/20 |
| 2014/0252783 | A1 * | 9/2014 | Yokota | E05B 81/20 292/196 |
| 2015/0061301 | A1 * | 3/2015 | Torka | E05B 85/20 292/194 |
| 2016/0186468 | A1 * | 6/2016 | Ilea | E05B 83/18 292/201 |
| 2018/0073284 | A1 * | 3/2018 | Im | E05B 81/34 |
| 2018/0087298 | A1 * | 3/2018 | Strole | E05B 81/90 |
| 2018/0171677 | A1 * | 6/2018 | Im | E05B 83/16 |

* cited by examiner

TRUNK LID LATCH ASSEMBLY FOR VEHICLE

CROSS-REFERENCE(S) TO RELATED APPLICATIONS

The present application claims priority to Korean Patent Application No. 10-2017-0069169, filed on Jun. 2, 2017, the entire contents of which is incorporated herein for all purposes by this reference.

BACKGROUND OF THE INVENTION

Field of the Invention

The present invention relates generally to a trunk lid latch assembly for a vehicle and, more particularly, to a trunk lid latch assembly for a vehicle, the trunk lid latch assembly configured for controlling locked and unlocked states of a trunk lid using a driving motor.

Description of Related Art

In general, a vehicle is provided with a trunk for loading objects, and the trunk is provided with a trunk lid or a tailgate. The trunk lid or tailgate, a door open by a person entering and exiting the vehicle, and an engine compartment hood are provided with a door latch engaged with and disengaged from a striker disposed on each door.

Particularly, in the case of a trunk lid latch or a tailgate latch disposed for opening and closing the trunk, when a user does not apply force for closing the trunk lid, a normal closing operation does not occur. In such a case, the user ascertains the door state via a signal on the instrument panel after sitting in a driver's seat, but then has to move out of the vehicle to check the trunk lid or tailgate again to ascertain the opening/closing state thereof. To solve the present problem, a power trunk lid or tailgate latch can be used to fully lock the trunk lid or tailgate through a drive motor.

However, in the past two driving motors were disposed to transmit power in separate directions for locking and opening. However, these motors were excessively bulky, so it was difficult to mount them inside a vehicle body.

The information disclosed in the present Background of the Invention section is only for enhancement of understanding of the general background of the invention and should not be taken as an acknowledgement or any form of suggestion that the present information forms the prior art already known to a person skilled in the art.

BRIEF SUMMARY

Various aspects of the present invention are directed to providing a trunk lid latch assembly for a vehicle in which both locking and unlocking functions of a trunk lid latch are realized using a drive motor, and an emergency opening function of the trunk lid latch is provided.

According to various aspects of the present invention, there is provided a trunk lid latch assembly for a vehicle, the trunk lid latch assembly including: a base provided at a first side thereof with a first insertion hole through which a striker is inserted or withdrawn; a main gear disposed at a second side of the base and provided on a first rotation shaft to be rotatable by a drive motor; a claw rotatably disposed on the base at a position where the first insertion hole is provided, with a second insertion hole being indented inwardly on the claw and into which the striker is inserted, wherein when the striker is inserted into the first and second insertion holes, the striker is locked by the claw; a cinching member disposed adjacent to both the main gear and the claw, the cinching member being operated wherein the striker is locked or unlocked by the claw, by an error lever disposed across the main gear and the claw, and by a pawl lever configured for locking or unlocking the claw; and a plurality of links coupled to the cinching member and configured to be operated in conjunction with a rotation of the main gear.

The cinching member may be provided with a cinching pin, and the claw may be provided with a recess portion guiding the cinching pin, wherein when the links are operated, the cinching pin is pressed and moved along the recess portion, realizing cinching.

The error lever may be provided with a guide slit extending in a left and right direction of the base, wherein when the links are operated, the cinching pin is pressed and moved along the recess portion in the guide slit, realizing cinching.

The plurality of links may include: a first link extending in an up and down direction of the base, the first link being connected at a first end portion thereof to the error lever configured to press the error lever and being rotatably connected at a second end portion thereof to the second link; and a second link extending in a left and right direction of the base, the second link being rotatably connected at a first end portion thereof to the first link and being connected at a second end portion thereof to the claw.

The cinching member may be coupled to the second link wherein when the main gear is rotated, the cinching pin of the cinching member is operated in conjunction with movements of the first and second links.

The first link may be provided at the first end portion thereof with a release pin, and the error lever may be provided with a locking portion, wherein when the main gear is rotated, the release pin presses the locking portion of the error lever and then the error lever and the pawl lever are rotated, wherein the pawl lever and the claw are disengaged from each other.

The first link may be provided at the first end portion thereof with a locking portion, wherein when the main gear is rotated, the locking portion of the first link presses a locking portion of the error lever and then the error lever and the pawl lever are rotated, wherein the pawl lever and the claw are disengaged from each other.

The claw may be provided with a first locking protrusion and a second locking protrusion that are formed along an external periphery of the claw wherein the pawl lever is stepwisely engaged with the first and second locking protrusions, realizing stepwise locking or stepwise unlocking of the striker.

The base may include: a first switch configured to detect a full locking state of the claw; a second switch configured to detect a half locking state of the claw; a third switch configured to detect a position of the main gear; and a controller configured for receiving position signals from the first, second and third switches and controlling the drive motor, wherein the controller controls driving of the drive motor according to positional information received from the first, second and third switches.

When the controller receives a signal from the second switch, the controller may drive the drive motor to perform cinching.

When the controller receives a signal from the first switch, the controller may terminate cinching.

When the controller receives a signal from the third switch after receiving a signal from the first switch, the controller may terminate cinching.

When the controller receives a signal from the third switch, the controller may detect the position of the main gear.

When the controller receives a signal from the third switch, the controller may control the drive motor to be rotated wherein the main gear is returned to an initial predetermined position.

The first switch may function as an ajar switch, wherein a separate ajar switch is removed.

According to the trunk lid latch assembly for the vehicle having the above-described configuration, the trunk lid latch assembly has a cinching mechanism-integrated power latch structure. By use of the drive motor and the main gear, and by implementing the integrated cinching mechanism structure through the link structure, it is possible to reduce the number of components by the simplified structure, achieving production cost reduction and weight reduction. In addition, loss of operating force can be reduced, and the main gear can be rotated in the clockwise or counterclockwise direction to realize bidirectional release, improving product quality.

Furthermore, since half locking and full locking can be realized by only the pawl lever and the claw, cinching can be realized by only the cinching pin, wherein it is possible to increase accuracy of operation and durability of components.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
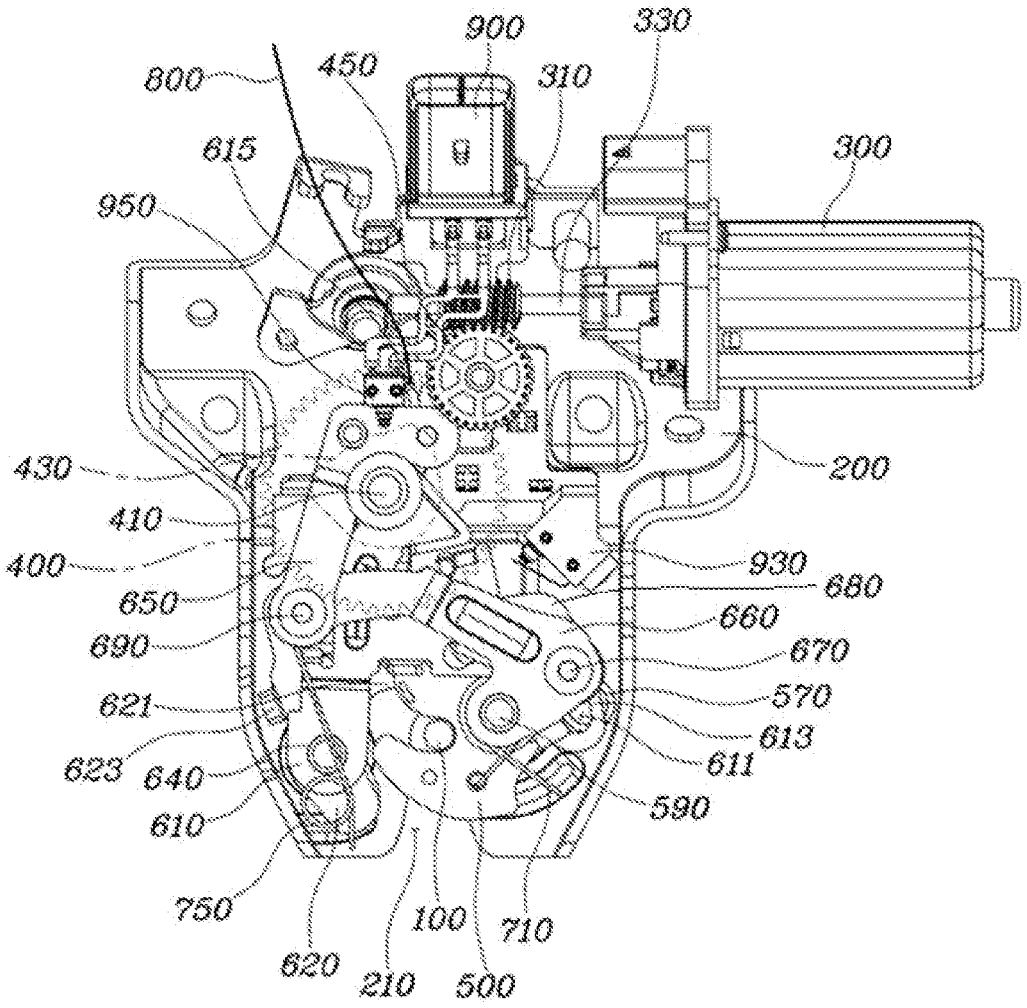
FIG. 1 is a view showing a closed state of a trunk lid latch assembly for a vehicle according to various exemplary embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
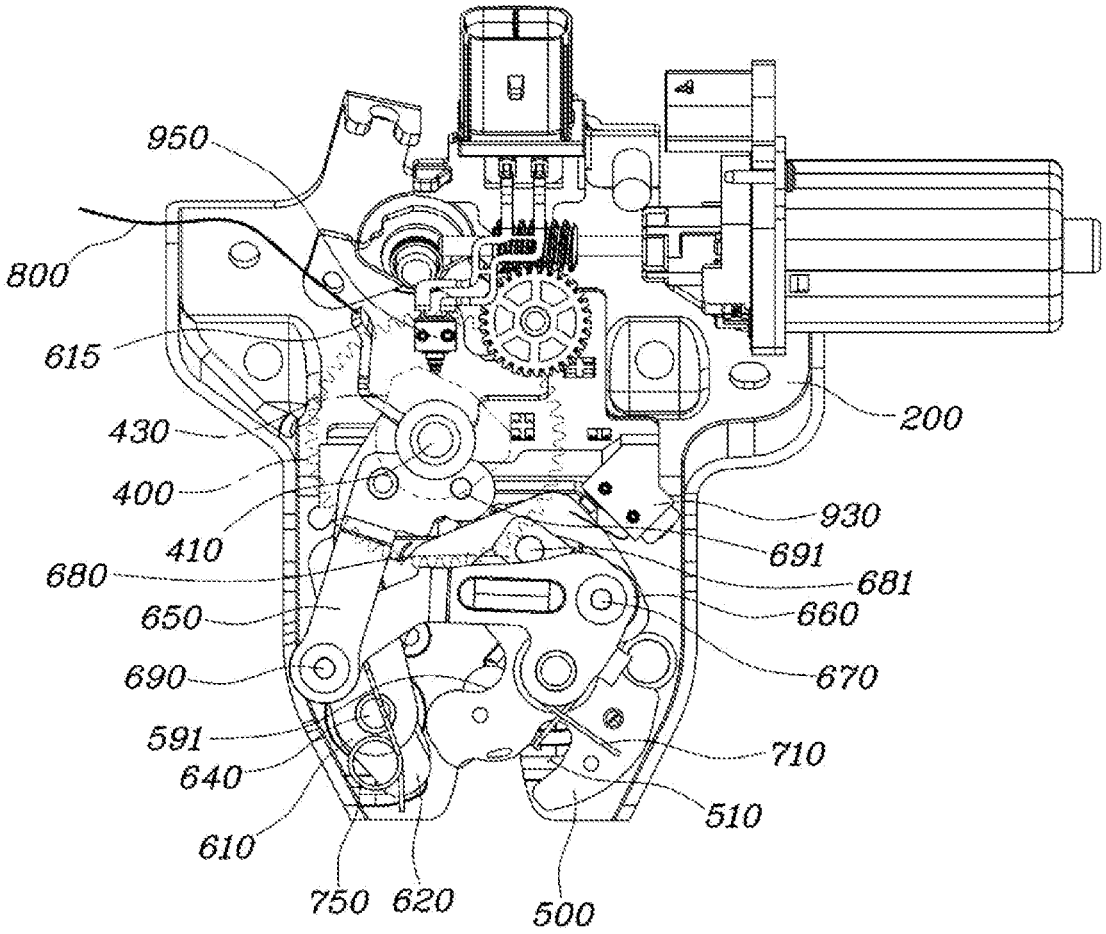
FIG. 2 is a view showing an open state.
Figure 3:
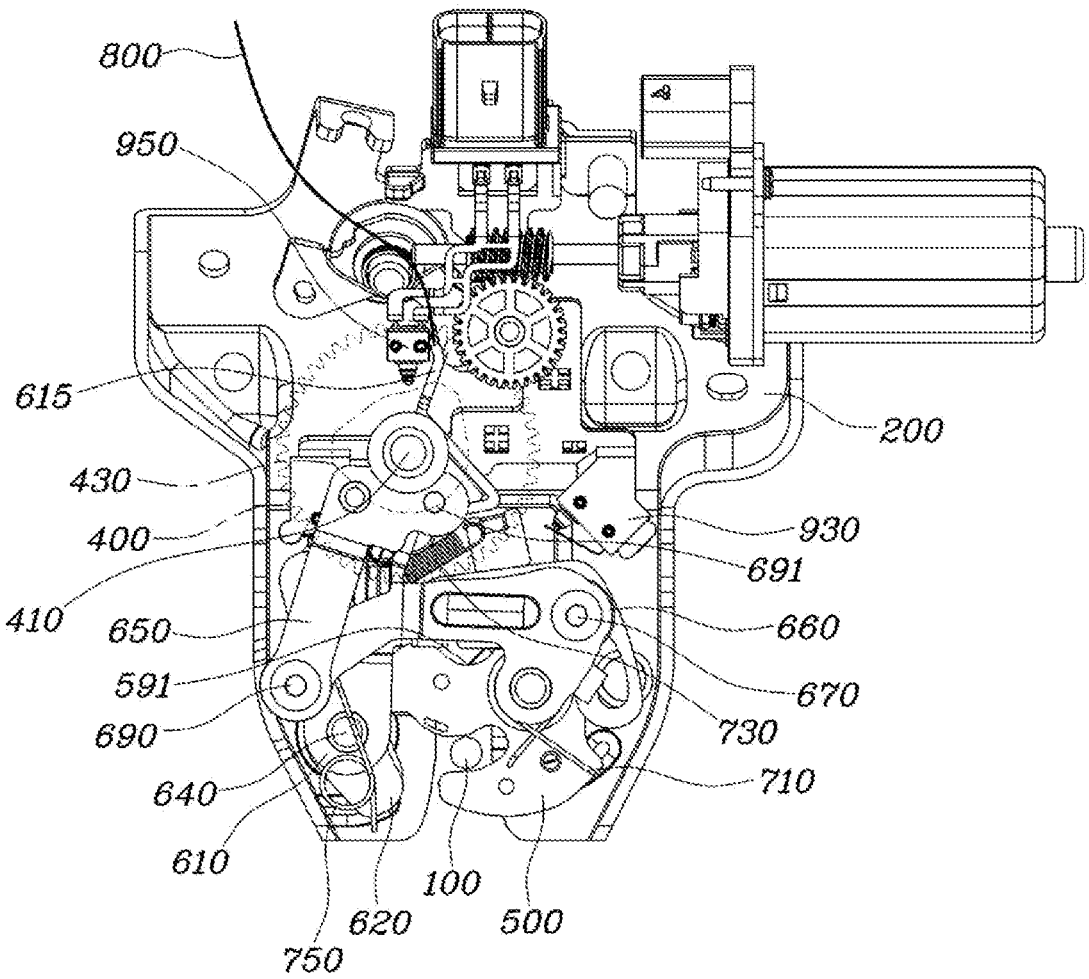
FIG. 3 is a view showing a half locking state and a cinching state.
Figure 4:
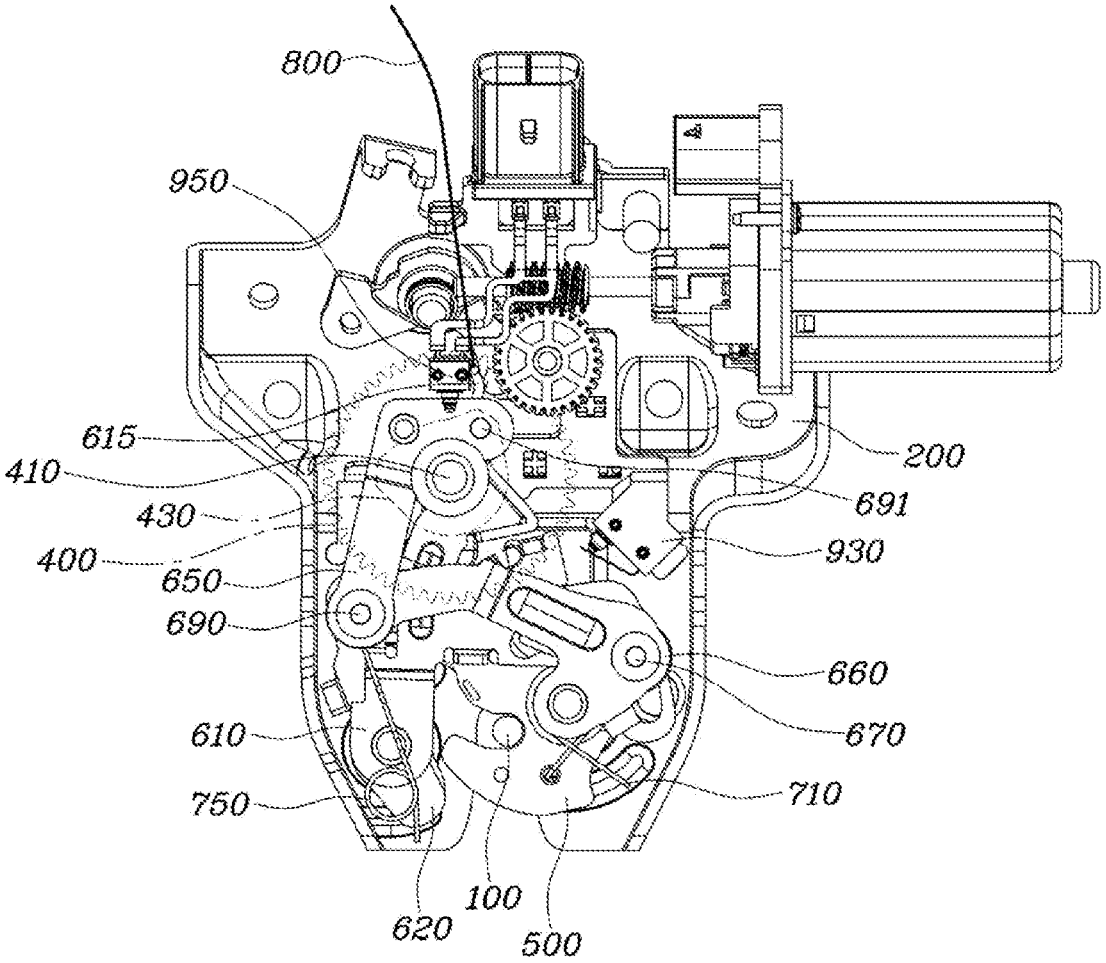
FIG. 4 is a view showing a full locking state.
Figure 5:
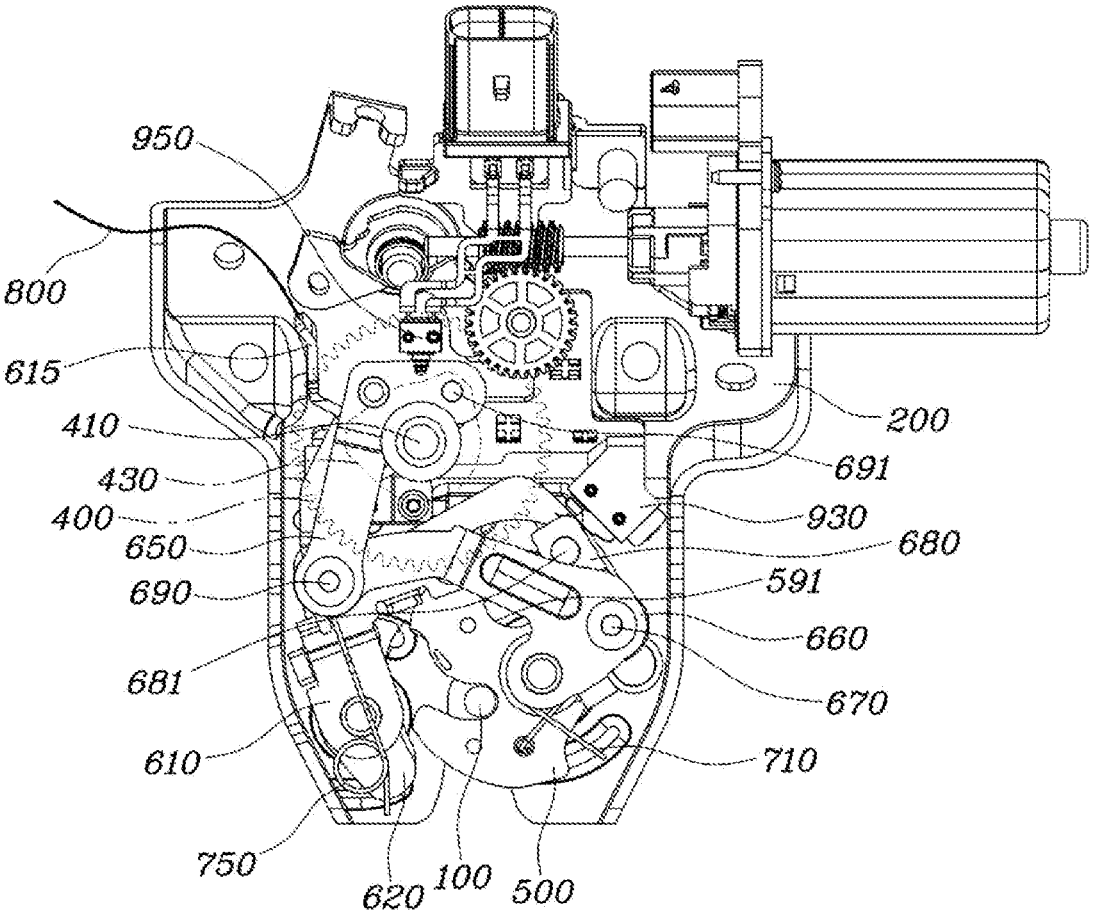
FIG. 5 is a view showing an interrupt state.
Figure 6:
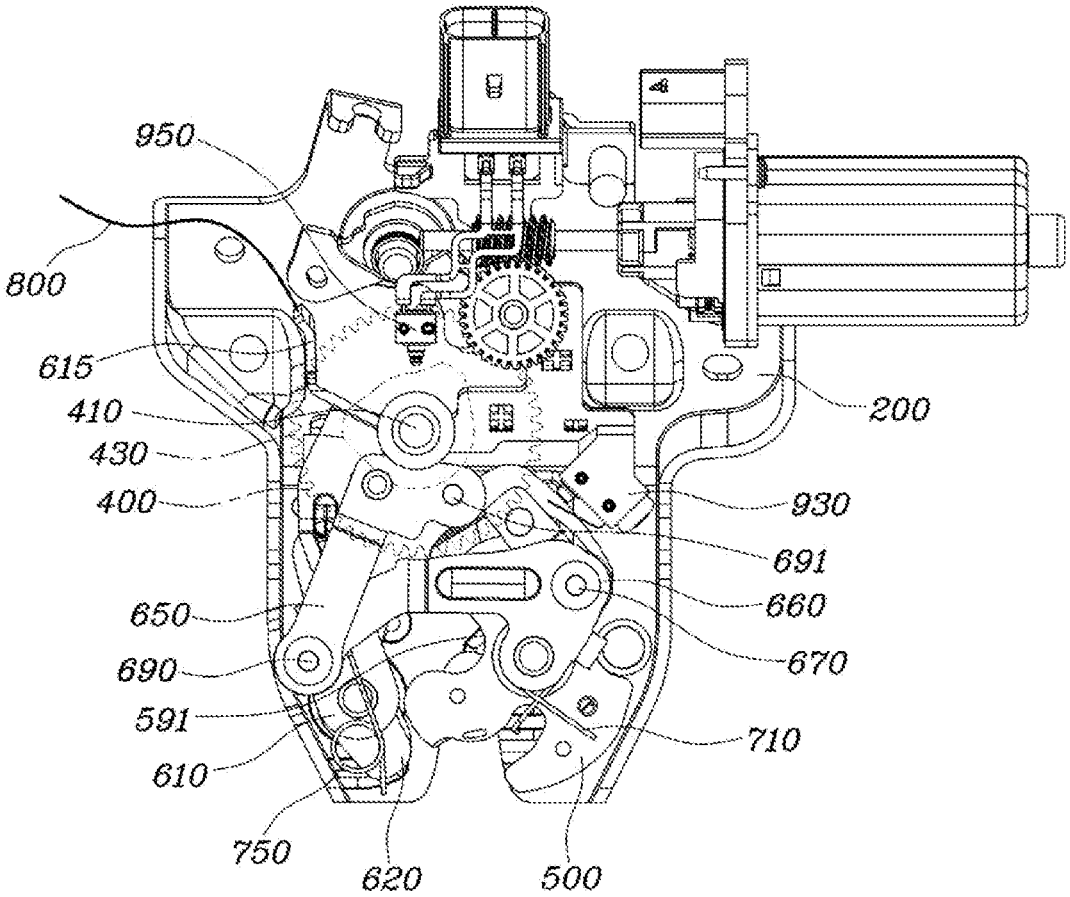
FIG. 6 is a view showing an open state according to various exemplary embodiments of the present invention.
Figure 7:
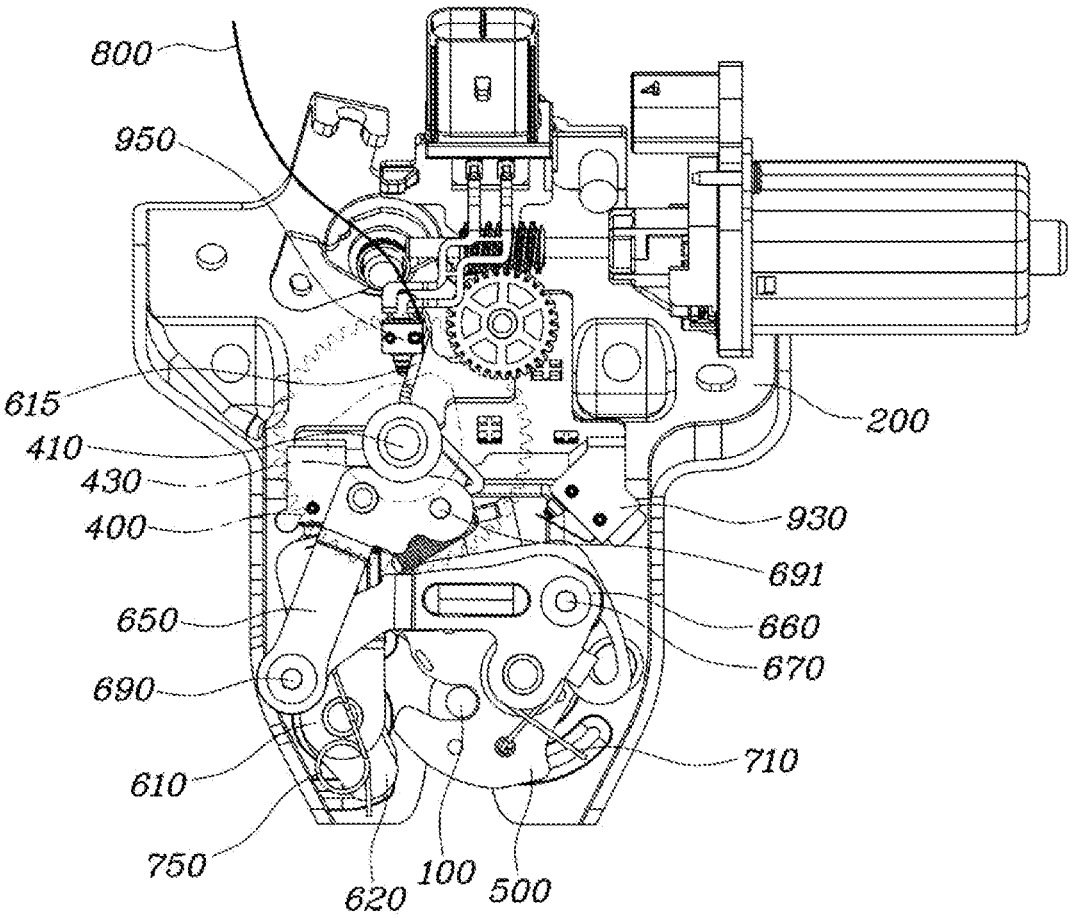
FIG. 7 is a view showing a closed state according to the various exemplary embodiments.
Figure 8:
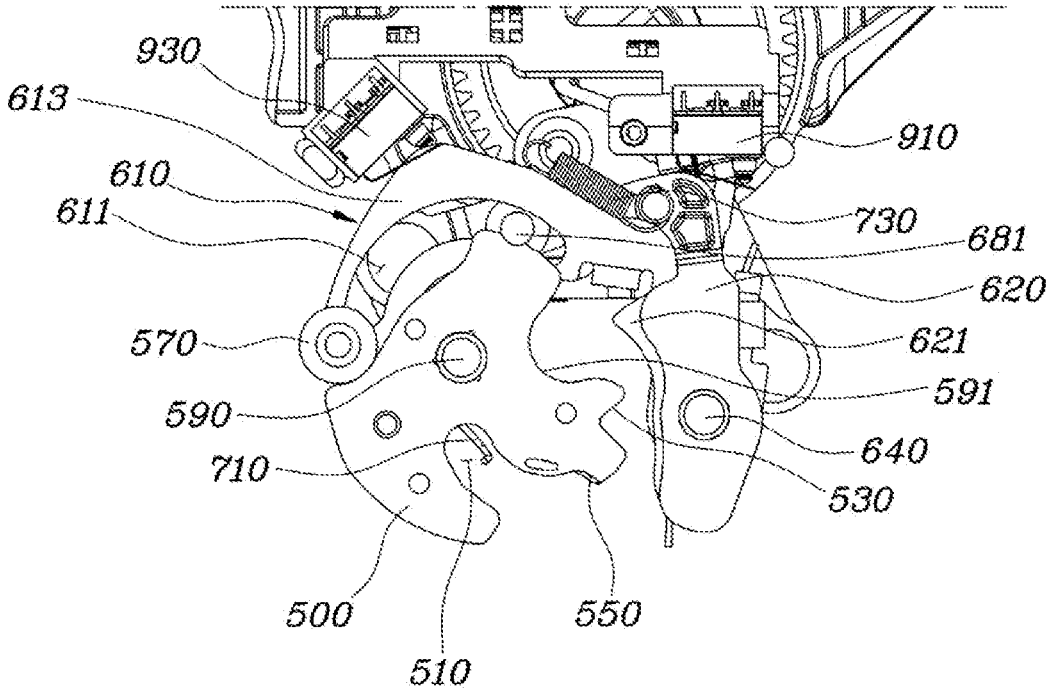
FIG. 8 and FIG. 9 are views showing operation of a cinching pin according to various exemplary embodiments of an error lever.
Figure 9:
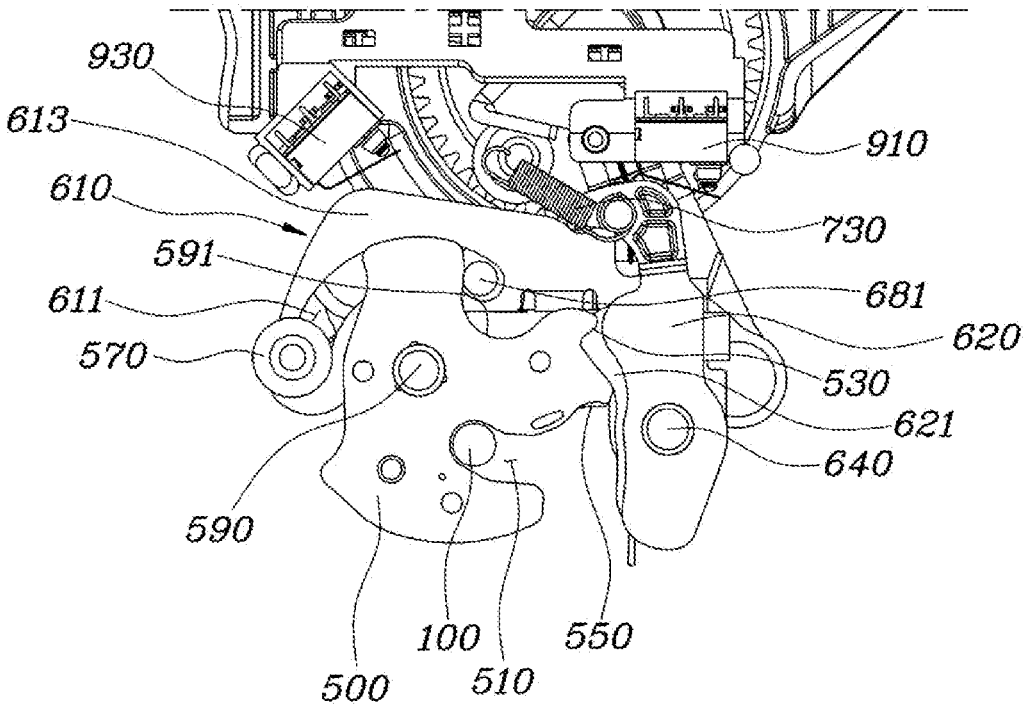
Figure 10:
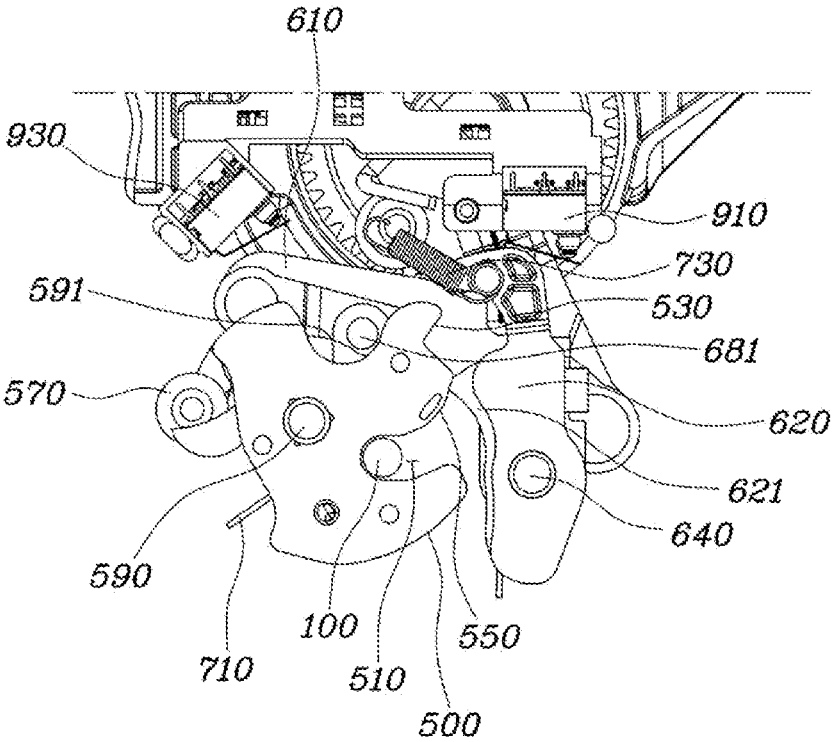
FIG. 10 is a view showing operation of the cinching pin according to various exemplary embodiments of the error lever.

FIG. 1 is a view showing a closed state of a trunk lid latch assembly for a vehicle according to various exemplary embodiments of the present invention, FIG. 2 is a view showing an open state, FIG. 3 is a view showing a half locking state and a cinching state, FIG. 4 is a view showing a full locking state, and FIG. 5 is a view showing an interrupt state. Furthermore, FIG. 6 is a view showing an open state according to various exemplary embodiments of the present invention, and FIG. 7 is a view showing a closed state according to the various exemplary embodiments. Furthermore, FIG. 8 to FIG. 9 are views showing operation of a cinching pin 681 according to various exemplary embodiments of an error lever 610, and FIG. 10 is a view showing operation of the cinching pin 681 according to various exemplary embodiments of the error lever 610.

As shown in FIG. 1, a trunk lid latch assembly for a vehicle may include a base 200 provided at a first side thereof with a first insertion hole 210 through which a striker 100 is inserted or withdrawn; a main gear 400 disposed at a second side of the base 200, and provided on a first rotation shaft 410 configured to be rotatable by a drive motor 300; a claw 500 rotatably disposed on the base 200 at a position where the first insertion hole 210 is provided, with a second insertion hole 510 being indented inwardly on the claw 500 and into which the striker 100 is inserted, wherein when the striker 100 is inserted into the first and second insertion holes 210 and 510, the striker 100 is locked by the claw 500; a cinching member 680 disposed adjacent to both the main gear 400 and the claw 500, the cinching member 680 being operated wherein the striker 100 is locked or unlocked by the claw 500, by an error lever 610 disposed across the main gear 400 and the claw 500, and by a pawl lever 620 locking or unlocking the claw 500; and a plurality of links coupled to the cinching member 680 and operated in conjunction with rotation of the main gear 400.

The base 200 has a plate shape and is formed by being bent at an edge portion thereof wherein various components are seated inside the base 200. Of course, depending on the environment or design, the components may be seated in a cover of the base 200. The base 200 is provided at the first side thereof with the first insertion hole 210 through which the striker 100 is inserted or withdrawn. The first insertion hole 210 is indented from a lower side to an upper side in the drawing.

The base 200 is provided at the second side thereof with the main gear 400 rotatable by driving of the drive motor 300. The drive motor 300 includes a motor shaft 330 and a worm gear 310 provided on the motor shaft 330. In addition, the drive motor 300 may further include an auxiliary gear 450 for adjusting the revolutions of the drive motor 300 as required. Accordingly, when the drive motor 300 is driven, the motor shaft 330 is rotated and then the worm gear 310 is rotated in conjunction with rotation of the motor shaft 330, wherein the main gear 400 is rotated on the first rotation shaft 410 in conjunction with rotation of the worm gear 310.

Furthermore, the main gear 400 is coupled to the plurality of links 650 and 660. The links 650 and 660 include a first link 650 and a second link 660. The first link 650 extends in an up and down direction of the base 200, and a first end portion of the first link 650 is connected to the error lever 610 configured to press the error lever, and a second end portion of the first link 650 is rotatably connected to the second link 660. The second link 660 extends in a left and right direction of the base 200, and a first end portion of the second link 660 is rotatably connected to the first link 650, and a second end portion of the second link 660 is connected to the claw 500.

The first link 650 extends in a radial direction of the first rotation shaft 410 of the main gear 400. The first link 650 is connected at the first end portion thereof to the main gear 400 directly or indirectly wherein the first link 650 is rotated when the main gear 400 is rotated, and is pin-coupled at the second end portion thereof to the second link 660 to form a first coupling portion 690. In addition, the first end portion of the first link 650 may be bent at a predetermined angle to have a predetermined length. The first link 650 is provided at the first end portion thereof with a release pin 691 extending toward the base 200. The release pin 691 is a device for pressing the error lever 610, and the error lever 610 is provided with a locking portion 615. When the main gear 400 is rotated, the release pin 691 presses the locking portion 615 of the error lever 610 wherein the error lever 610 and the pawl lever 620 are rotated around a third rotation shaft 640, and the pawl lever 620 and the claw 500 are disengaged from each other. More details regarding operations in each step will be described later. Of course, the release pin 691 may have a locking portion including a locking protrusion rather than being formed in a pin shape, and the shape of the release pin 691 may not be limited as long as the release pin 691 can press the locking portion 615 of the error lever 610.

The second link 660 is pin-coupled at the first end portion thereof to the first link 650 to form the first coupling portion 690, and is rotatably pin-coupled at the second end portion thereof to a second rotation shaft 590 of the claw 500. The cinching member 680 may be provided on the second link 660, or may be disposed as a separate member to be coupled to the second link 660. The cinching member 680 and the second link 660 may be pin-coupled to each other through a second coupling portion 670. Accordingly, when the main gear 400 is rotated, the first link 650 is rotated, the second link 660 is operated in conjunction with a movement of the first link 650, and the cinching pin 681 of the cinching member 680 is operated in conjunction with a movement of the second link 660. Thus, the second link 660 is moved about the first coupling portion 690 when the first link 650 is rotated, and the cinching pin 681 of the cinching member 680 coupled to the second link 660 is moved, realizing cinching.

The error lever 610 is placed between the main gear 400 and the claw 500. The error lever 610 is disposed at a side of the claw 500 by extending in the up and down direction of the base 200, and is rotatable by the third rotation shaft 640. The error lever 610 is pin-coupled at a first end portion thereof to the third rotation shaft 640 to be rotatable together with the pawl lever 620, and extends at a second end portion thereof toward the main gear 400. The error lever 610 is provided at the second side thereof with the locking portion 615 wherein the locking portion 615 of the error lever 610 is pressed by the release pin 691 via pressure-contact or release between the locking portion 615 and the release pin 691. The locking portion 615 may be bent toward the release pin 691 to have a predetermined angle wherein the release pin 691 is prevented from being separated from the locking portion 615 when the release pin 691 presses the locking portion 615.

Furthermore, the error lever 610 is provided with an extension portion 613 extending in a left and right direction of the base 200. The extension portion 613 is disposed across the main gear 400 and the claw 500. The claw 500 is provided with a recess portion 591 recessed toward the second rotation shaft 590 to have a gentle semi-spherical shape for guiding the cinching pin 681, the claw 500 having a shape wherein the cinching pin 681 can be locked in the recess portion 591 to be prevented from separation. Thus, when the drive motor 300 is rotated, the cinching pin 681 is pressed and moved along the recess portion 591 in conjunction with movements of the plurality of links 650 and 660, realizing cinching.

In another exemplary embodiment of the present invention, the extension portion 613 of the error lever 610 may be provided with a guide slit 611 extending in the left and right direction of the base 200 configured to correspond to the shape of the extension portion 613. Thus, when the plurality of links 650 and 660 are operated, and the cinching pin 681 is pressed and moved along the recess portion 591 in the guide slit 611, realizing cinching. The guide slit 611 may be formed in an arc shape to efficiently guide the cinching pin 681. Exemplary embodiments of such error lever 610 are shown in FIG. 8, FIG. 9, and FIG. 10.

The cinching member 680 is disposed between the second link 660 and the base 200. The cinching pin 681 of the cinching member 680 protrudes toward the base 200 and is slidably moved along the recess portion 591 of the claw 500. In the various exemplary embodiments of the error lever 610, an upper surface of the extension portion 613 of the error lever 610 has a guide structure wherein when the cinching pin 681 is moved along the recess portion 591, the cinching pin 681 is guided along a curve formed on the upper surface of the extension portion 613 of the error lever 610. In the present case, a second elastic member 730 is provided between the second link 660 and the cinching member 680 to facilitate movement of the cinching pin 681. Furthermore, in the various exemplary embodiments of the error lever 610, the extension portion 613 of the error lever 610 is provided with the guide slit 611 wherein when the cinching pin 681 is moved along the recess portion 591, the cinching pin 681 is guided to move in the guide slit 611. In the present case, the second elastic member 730 is provided between the error lever 610 and the pawl lever 620 to facilitate the movement of the cinching pin 681. In addition, a rotation guide member 570 may be disposed between the claw 500 and the error lever 610 to guide rotation of the claw 500 when the cinching pin 681 is moved.

The pawl lever 620 is coupled to the base 200 to be rotatable together with the error lever 610 by the third rotation shaft 640. The pawl lever 620 is placed between the base 200 and the error lever 610. The pawl lever 620 is provided with a locking protrusion 621 extending toward the claw 500 and preventing or allowing rotation of the claw 500, and the pawl lever 620 is provided with a rotation protrusion 623 protruding from the base 200 in a direction opposite to the base 200. Accordingly, when the error lever 610 is rotated the error lever 610 is caught by the rotation protrusion 623, and thus the error lever 610 and the pawl lever 620 can be rotated simultaneously. The third rotation shaft 640 is provided with a third elastic member 750 biasing the error lever 610 and the pawl lever 620 toward the claw 500.

The claw 500 is provided with a first locking protrusion 530 and a second locking protrusion 550 that are formed along an external periphery of the claw 500, wherein the locking protrusion 621 of the pawl lever 620 is engaged with the first and second locking protrusions 530 and 550 in a stepwise manner, realizing stepwise locking or stepwise unlocking of the striker 100. A state where the locking protrusion 621 is engaged with the first locking protrusion 530 is referred to as a half locking state, and a state where the locking protrusion 621 is engaged with the second locking protrusion 550 is referred to as a full locking state. Thus, both the half locking and the full locking can be realized by only the pawl lever 620 and the claw 500, and the cinching pin 681 is operated to realize cinching.

Furthermore, the second rotation shaft 590 of the claw 500 is provided with a first elastic member 710 configured to bias the claw 500 toward the first insertion hole 210, wherein the claw 500 is normally biased toward the first insertion hole 210. Accordingly, the third elastic member 750 provided on the third rotation shaft 640 biases the pawl lever 620 toward the first insertion hole 210, and the first elastic member 710 provided on the second rotation shaft 590 of the claw 500 biases the claw 500 toward the first insertion hole 210. Thus, the pawl lever 620 and the claw 500 can maintain locking of the striker 100. Here, the second and third elastic members 730 and 750 may be provided to facilitate rotation of the pawl lever 620 and the error lever 610, respectively, or may perform the same function with only one elastic member depending on the environment or design.

The trunk lid or tailgate of the vehicle may be provided with an emergency handle. The emergency handle may be rotatably disposed at an upper side of the error lever 610. Accordingly, when users open the trunk lid or tailgate using keys or by operating the emergency handle, the wire 800 connected to the emergency handle is pulled and then the emergency handle is rotated, wherein the error lever 610, which is in contact with the emergency handle, is rotated. Here, the emergency handle may be connected to a link connected to the error lever 610, or may be directly connected to the error lever 610. Thus, the pawl lever 620 is rotated as the error lever 610 is rotated by the operation of the emergency handle, and then the claw 500 is rotated as contact between the pawl lever 620 and the claw 500 is released, wherein the striker 100 is unlocked from the claw 500.

The base 200 includes a first switch 910 configured to detect the full locking state of the claw 500, a second switch 930 configured to detect the half locking state of the claw 500, a third switch 950 configured to detect an initial position of the main gear 400, and a controller 900 configured for receiving position signals from the first, second and third switches 910, 930, 950 and controlling the drive motor 300. The first switch 910 is placed adjacent to the pawl lever 620 and detects a changed position of the pawl lever 620, the second switch 930 is placed adjacent to the extension portion 613 of the error lever 610 and detects a changed position of the extension portion 613 of the error lever 610, and the third switch 950 is placed adjacent to the main gear 400 and detects a current position or a changed position of the main gear 400. The first switch 910 may be placed adjacent to the claw 500. The main gear 400 may be further provided with a cam-shaped position recognition member 430. Thus, the third switch 950 can detect the changed position of the main gear 400 through the position recognition member 430.

In addition, the controller 900 is configured to control driving of the drive motor 300 according to positional information received from the first, second and third switches 910, 930, 950, realizing cinching. Thus, when the striker 100 is inserted into the first insertion hole 210 and the second insertion hole 510, the pawl lever 620 is rotated. As such, the second switch 930 detects a positional change of the rotated pawl lever 620, and the controller 900 drives the drive motor 300 to start cinching. As such, when the controller 900 receives a signal from the first switch 910, or receives a signal from the third switch 950 after receiving the signal from the first switch 910, the controller 900 terminates cinching.

Furthermore, when the trunk lid or tailgate is opened, the controller 900 receives information related to the changed position or current position of the main gear 400 from the third switch 950 after the striker 100 is separated from the claw 500. Furthermore, in the exemplary embodiment in which the trunk lid latch assembly is configured to allow rotation in opposite directions, the controller 900 controls the drive motor 300 to be rotated wherein the main gear 400 is returned to an initial predetermined position.

In other words, when the controller 900 receives an open signal to open the trunk lid or tailgate, the controller 900 drives the drive motor 300 wherein the release pin 691 of the first link 650 biases the locking portion 615 of the error lever 610, and thus the error lever 610 is rotated. As such, the pawl lever 620 is rotated and the claw 500 is rotated in conjunction with the rotation of the pawl lever 620, and thus locking of the striker 100 is released. The first switch 910 in an exemplary embodiment of the present invention functions as an ajar switch, wherein it is possible to remove requirement of a separate ajar switch provided at the trunk lid or tailgate of the vehicle.

The trunk lid latch assembly of the luggage compartment for the vehicle according to the exemplary embodiment of the present invention will be described in detail with reference to the drawings. In an exemplary embodiment of the present invention, the trunk lid latch assembly for the vehicle is configured to allow rotation in one direction or in opposite directions, and therefore each case will be described.

First, a case in which a trunk lid latch assembly for a vehicle according to the various exemplary embodiments of the present invention is configured to allow rotation in one direction will be described.

First, an opening mechanism that opens vehicle's trunk lid or tailgate from a closed state will be described with reference to FIG. 1 (closed state) and FIG. 2 (open state). Although not shown in the drawings, in the case of the open state, when the user sends the open signal in the state where the vehicle's trunk lid or tailgate is closed, the main gear 400 is rotated in a counterclockwise (CCW) direction thereof. As such, the locking portion 615 of the error lever 610 is pressed by the release pin 691 of the first link 650 and is rotated in the CCW direction thereof. Accordingly, the error lever 610 is moved toward the external of the base 200, and then the rotation protrusion 623 of the pawl lever 620 is pressed by the error lever 610, wherein the pawl lever 620 is rotated in the CCW direction away from the claw 500. Accordingly, the claw 500 is rotated in the CCW direction about the second rotation shaft 590 and then the striker 100 is separated from the first and second insertion holes 210 and 510, wherein the trunk lid or tailgate is opened.

Second, a cinching mechanism that closes the vehicle's trunk lid or tailgate from an open state will be described with reference to FIG. 2 (open state), FIG. 3 (half locking state and cinching state), FIG. 4 (full locking state), and FIG. 1 (closed state).

In the state of FIG. 2 in which the trunk lid or tailgate is fully opened by the above-described opening mechanism, the error lever 610 and the pawl lever 620 are moved opposite to the claw 500, and contact between the pawl lever 620 and the claw 500 is released. The cinching pin 681 of the cinching member 680 is positioned on the periphery of the claw 500 in the guide slit 611 of the extension portion 613 of the error lever 610. Since the second insertion hole 510 of the claw 500 is in an open state, the striker 100 is in a separated state (FIG. 2).

When the user presses and closes the trunk lid or tailgate in the present state, the tailgate is moved downward, wherein the striker 100 provided on the vehicle is inserted into the first insertion hole 210 of the base 200 and the second insertion hole 510 of the claw 500 and then presses the claw 500. As such, the claw 500 is rotated in a clockwise (CW) direction by a pressure force acting on the claw 500, realizing half locking of FIG. 3. Here, a counterclockwise CCW moment generated by the second elastic member 730 is applied to the error lever 610, so when the claw 500 is in the half locking state the cinching pin 681 of the cinching member 680 slides in the guide slit 611 of the error lever 610 to a position for cinching (FIG. 3).

In the above half locking state, the locking protrusion 621 of the pawl lever 620 and the first locking protrusion 530 of the claw 500 are engaged with each other, realizing the half locking state. As such, the controller 900 receives a cinching signal from the second switch 930 detecting the half locking, and drives the drive motor 300 to perform cinching. In other words, the controller 900 drives the main gear 400 to be rotated in the CCW direction, wherein the first and second links 650 and 660 are rotated, and then the cinching pin 681 of the cinching member 680 slides in the guide slit 611 of the extension portion 613 of the error lever 610. The error lever 610 is rotated in the CW direction by the second elastic member 730, and the second link 660 is rotated in the CW direction around the second rotation shaft 590, realizing the full locking state (FIG. 4).

FIG. 4 shows the full locking state in which when the signal from the second switch 930 is transmitted in the state of FIG. 3, the main gear 400 is rotated in the CCW direction to realize cinching. In other words, the cinching member 680 of the second link 660 is moved in the direction away from the main gear 400, and the claw 500 is rotated in the CW direction around the second rotation shaft 590. As such, the locking protrusion 621 of the pawl lever 620 and the second locking protrusion 550 of claw 500 are engaged to each other, realizing the full locking state. Here, when the controller 900 receives the signal from the first switch 910 detecting the full locking, the controller 900 stops driving of the drive motor 300 and then completes cinching. On the other hand, when the controller 900 receives the signal from the third switch 950 after receiving the signal from the first switch 910, the controller 900 stops driving of the drive motor 300 and then completes cinching. Here, in the case of opening the trunk lid or tailgate, the signal from the third switch 950 may be transmitted before the first link 650 presses the error lever 610. In other words, in the case of rotation in one direction, cinching may be selectively performed wherein cinching terminates when the signal from the first switch 910 is transmitted, or terminates when the signal from the third switch 950 is transmitted after the signal from the first switch 910 is transmitted.

FIG. 1 shows the state after the completion of cinching. The controller 900 detects a position of the main gear 400 by receiving the signal from the third switch 950 after cinching is completed. Thus, in the above-described various exemplary embodiments, the controller 900 drives the drive motor 300 to rotate the main gear 400 in only one direction (CCW direction), realizing cinching.

Finally, FIG. 5 shows an interrupt operation. When the user opens the trunk lid or tailgate with keys or manually opens the trunk lid or tailgate via the emergency handle in the state in which cinching is performed as shown in FIG. 1, FIG. 2, FIG. 3, and FIG. 4, the wire 800 connected to the error lever 610 is pulled to open the trunk lid or tailgate, and the controller 900 determines that an interrupt situation occurs.

As shown in FIG. 5, when the controller 900 determines that the interrupt situation occurs, the error lever 610 is rotated in the CCW direction about the third rotation shaft 640 by the emergency handle. As such, the pawl lever 620 supporting the claw 500 is separated apart from the claw 500, wherein the striker 100 is separated from the first insertion hole 210 of the base 200 and the second insertion hole 510 of the claw 500. Thus, locking of the striker 100 is released.

Next, a case in which a trunk lid latch assembly for a vehicle according to various exemplary embodiments of the present invention is configured to allow rotation in opposite directions will be described.

First, an opening mechanism that opens the vehicle's trunk lid or tailgate from the closed state will be described with reference to FIG. 7 (closed state) and FIG. 6 (open state). Although not shown in the drawings, in the case of the open state when the user sends the open signal in the state where the vehicle's trunk lid or tailgate is closed, the main gear 400 is rotated in the CW direction thereof. As such, the locking portion 615 of the error lever 610 is pressed by the release pin 691 of the first link 650 and is rotated in the CCW direction thereof. Accordingly, the error lever 610 is moved toward the external of the base 200, and the rotation protrusion 623 of the pawl lever 620 is pressed by the error lever 610, wherein the pawl lever 620 is rotated in the CCW direction away from the claw 500. Accordingly, the claw 500 is rotated in the CCW direction about the second rotation shaft 590 and then the striker 100 is separated from the first and second insertion holes 210 and 510, wherein the trunk lid or tailgate is opened. After the tailgate is opened, the main gear 400 is rotated in the CCW direction by signals from the third switch 950 and the position recognition member 430, and thus the main gear 400 is returned to the initial predetermined position.

Second, a cinching mechanism that closes the vehicle's trunk lid or tailgate from an open state will be described with reference to FIG. 6 (open state), FIG. 3 (half locking state and cinching state), FIG. 4 (full locking state), and FIG. 7 (closed state).

In the state of FIG. 6 in which the trunk lid or tailgate is fully opened by the above-described opening mechanism, the error lever 610 and the pawl lever 620 are moved opposite to the claw 500, and contact between the pawl lever 620 and the claw 500 is released. The cinching pin 681 of the cinching member 680 is positioned on the periphery of the claw 500 in the guide slit 611 of the extension portion 613 of the error lever 610. Since, the second insertion hole 510 of the claw 500 is in the open state, the striker 100 is in the separated state (FIG. 2).

When the user presses and closes the tailgate in the present state, the trunk lid or tailgate is moved downward, wherein the striker 100 provided on the vehicle is inserted into the first insertion hole 210 of the base 200 and the second insertion hole 510 of the claw 500, and then presses the claw 500. As such, the claw 500 is rotated in the CW direction by the pressure force acting on the claw 500, realizing the half locking state of FIG. 3. Here, the CCW moment generated by the second elastic member 730 is applied on the error lever 610, so when the claw 500 is in the half locking state, the cinching pin 681 of the cinching member 680 slides in the guide slit 611 of the error lever 610 to the position for cinching (FIG. 3).

In the half locking state, the locking protrusion 621 of the pawl lever 620 and the first locking protrusion 530 of the claw 500 are engaged to each other, realizing the half locking state. As such, the controller 900 receives the cinching signal from the second switch 930 detecting the half locking, and drives the drive motor 300 to perform cinching. In other words, the controller 900 drives the main gear 400 to be rotated in the CCW direction, wherein the first and second links 650 and 660 are rotated, and then the cinching pin 681 of the cinching member 680 slides in the guide slit 611 of the extension portion 613 of the error lever 610. The error lever 610 is rotated in the CW direction by the second elastic member 730, and the second link 660 is rotated in the CW direction around the second rotation shaft 590, realizing the full locking state (FIG. 4).

FIG. 4 shows the full locking state in which when the signal from the second switch 930 is transmitted in the state of FIG. 3, the main gear 400 is rotated in the CCW direction to realize cinching. In other words, the cinching member 680 of the second link 660 is moved in the direction away from the main gear 400, and the claw 500 is rotated in the CW direction around the second rotation shaft 590. As such, the locking protrusion 621 of the pawl lever 620 and the second locking protrusion 550 of claw 500 are engaged to each other, realizing the full locking state. Here, when the controller 900 receives the signal from the first switch 910 detecting the full locking, the controller 900 stops driving of the drive motor 300 and then completes cinching.

FIG. 7 shows the state after the completion of cinching. After cinching is completed, the controller 900 detects a position of the main gear 400 by receiving the signal from the third switch 950 detecting a signal to recover to the initial predetermined position of the main gear 400. As such, the controller 900 drives the drive motor 300 to rotate the main gear 400 in the CW direction opposite to the direction in which the main gear 400 is rotated during cinching, and thus the main gear 400 is returned to the initial predetermined position.

Finally, FIG. 5 shows the interrupt operation. When the user opens the trunk lid or tailgate with keys or manually opens the trunk lid or tailgate via the emergency handle in the state in which cinching is performed as shown in FIG. 3, FIG. 4, FIG. 6, and FIG. 7, the wire 800 connected to the error lever 610 is pulled to open the tailgate, and the controller 900 determines that the interrupt situation occurs.

As shown in FIG. 5, when the controller 900 determines that the interrupt situation occurs, the error lever 610 is rotated in the CCW direction about the third rotation shaft 640 by the emergency handle. As such, the pawl lever 620 supporting the claw 500 is separated apart from the claw 500, wherein the striker 100 is separated from the first insertion hole 210 of the base 200 and the second insertion hole 510 of the claw 500. Thus, locking of the striker 100 is released.

As described above, in each operation of the first and various exemplary embodiments, the second switch 930 may transmit a signal to the controller 900 by detecting an external periphery of the arc-shaped guide slit 611 of the error lever 610.

Thus, the above-described trunk lid latch assembly for the vehicle has a cinching mechanism-integrated power latch structure. Using the drive motor 300 and the main gear 400 and by implementing the integrated cinching mechanism structure through the link structure, it is possible to reduce the number of components through the simplified structure, achieving production cost reduction and weight reduction. In addition, loss of operating force can be reduced, and the main gear 400 can be rotated in the CW or CCW direction to realize bidirectional release, improving product quality.

Furthermore, since the half locking and full locking can be realized by only the pawl lever 620 and the claw 500, the cinching can be realized by only the cinching pin 681, wherein it is possible to increase accuracy of operation and durability of components.

For convenience in explanation and accurate definition in the appended claims, the terms "upper", "lower", "up", "down", "upwards", "downwards", "internal", "outer", "inside", "outside", "inwardly", "outwardly", "internal", "external", "front", "rear", "back", "forwards", and "backwards" are used to describe features of the exemplary embodiments with reference to the locations of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A trunk lid latch assembly for a vehicle, the trunk lid latch assembly comprising:

a base provided at a first side thereof with a first insertion hole through which a striker is inserted or withdrawn;

a main gear disposed at a second side of the base, and provided on a first rotation shaft to be rotatable by a drive motor;

a claw rotatably disposed on the base at a position where the first insertion hole is provided, with a second insertion hole being indented inwardly on the claw and into which the striker is inserted, wherein, when the striker is inserted into the first and second insertion holes, the striker is locked by the claw;

a cinching member disposed in an opposed side from the main gear, and disposed at a first side thereof adjacent to the claw, the cinching member being operated such that the striker is locked or unlocked by the claw, by an error lever disposed across the main gear and the claw, and by a pawl lever locking or unlocking the claw; and a pair of links coupled to the cinching member, configured to be operated in conjunction with a rotation of the main gear, and independently rotatably linked from each other;

wherein the cinching member is provided with a cinching pin, and the claw is provided with a recess portion guiding the cinching pin, wherein, when the pair of links is operated the cinching pin is pressed and moved along the recess portion, realizing cinching, and wherein one of the pair of links allows the cinching member to move, and then engage the claw to realize cinching function of the cinching member when the main gear is rotated, and another of the pair of links allows the error lever to move to make the pawl lever to rotate and then disengage the claw when the main gear is rotated.

2. The trunk lid latch assembly of claim 1, wherein the error lever is provided with a guide slit extending in first and second directions of the base, wherein, when the pair of links is operated, the cinching pin is pressed and moved along the recess portion in the guide slit, realizing the cinching.

3. The trunk lid latch assembly of claim 1, wherein the pair of links includes:

a first link extending in up and down directions of the base, the first link being connected at a first end portion thereof to the error lever to press the error lever, and being rotatably connected at a second end portion thereof to the second link; and a second link extending in first and second directions of the base, the second link being rotatably connected at a first end portion thereof to the first link, and being connected at a second end portion thereof to the claw.

4. The trunk lid latch assembly of claim 3, wherein the cinching member is coupled to the second link wherein, when the main gear is rotated, the cinching pin of the cinching member is operated in conjunction with movements of the first and second links.

5. The trunk lid latch assembly of claim 3, wherein the first link is provided at the first end portion thereof with a release pin, and the error lever is provided with a locking portion, wherein, when the main gear is rotated, the release pin presses the locking portion of the error lever and then the error lever and the pawl lever are rotated, such that the pawl lever and the claw are disengaged from each other.

6. The trunk lid latch assembly of claim 3, wherein the first link is provided at the first end portion thereof with a locking portion, wherein, when the main gear is rotated, the locking portion of the first link presses a locking portion of the error lever and then the error lever and the pawl lever are rotated, such that the pawl lever and the claw are disengaged from each other.

7. The trunk lid latch assembly of claim 1, wherein the claw is provided with a first locking protrusion and a second locking protrusion that are formed along an external periphery of the claw and wherein the pawl lever is engaged with the first and second locking protrusions stepwisely, realizing stepwise locking or stepwise unlocking of the striker.

8. The trunk lid latch assembly of claim 1, wherein the base includes:

a first switch configured to detect a full locking state of the claw;

a second switch configured to detect a half locking state of the claw;

a third switch configured to detect a position of the main gear; and a controller configured for receiving position signals from the first, second and third switches and controlling the drive motor, wherein the controller is configured to control driving of the drive motor according to positional information received from the first, second and third switches.

9. The trunk lid latch assembly of claim 8, wherein, when the controller receives a signal from the second switch, the controller is configured to drive the drive motor to perform the cinching.

10. The trunk lid latch assembly of claim 8, wherein, when the controller receives a signal from the first switch, the controller is configured to terminate cinching.

11. The trunk lid latch assembly of claim 8, wherein, when the controller receives a signal from the third switch after receiving a signal from the first switch, the controller is configured to terminate the cinching.

12. The trunk lid latch assembly of claim 8, wherein, when the controller receives a signal from the third switch, the controller is configured to detect a position of the main gear.

13. The trunk lid latch assembly of claim 8, wherein, when the controller receives a signal from the third switch, the controller is configured to control the drive motor to be rotated so that the main gear is returned to an initial predetermined position.

14. The trunk lid latch assembly of claim 8, wherein the first switch is an ajar switch, so that a separate ajar switch is removed.

* * * * *